US009572215B2

(12) United States Patent
Datta

(10) Patent No.: US 9,572,215 B2
(45) Date of Patent: Feb. 14, 2017

(54) METHOD AND APPARATUS FOR DETECTING AND CORRECTING IMPROPER DIMMER OPERATION

(75) Inventor: Michael Datta, Brookline, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 569 days.

(21) Appl. No.: 13/697,611

(22) PCT Filed: Apr. 26, 2011

(86) PCT No.: PCT/IB2011/051806

§ 371 (c)(1), (2), (4) Date: Nov. 13, 2012

(87) PCT Pub. No.: WO2011/145009

PCT Pub. Date: Nov. 24, 2011

(65) Prior Publication Data

US 2013/0057180 A1 Mar. 7, 2013

Related U.S. Application Data

(60) Provisional application No. 61/345,283, filed on May 17, 2010.

(51) Int. Cl.
*H05B 37/02* (2006.01)
*G05F 5/02* (2006.01)
(Continued)

(52) U.S. Cl.
CPC ..... *H05B 33/0845* (2013.01); *H05B 33/0887* (2013.01)

(58) Field of Classification Search
CPC ..... G05F 1/00; G05F 1/452; G05F 1/455; H05B 37/02; H05B 33/0845; H05B 33/0887; H05B 33/0815; H05B 39/044; H05B 39/048; H05B 41/3924; H05B 7/00; H05B 7/144
(Continued)

(56) References Cited

U.S. PATENT DOCUMENTS 5,847,450 A 12/1998 Fink et al.
6,016,038 A 1/2000 Mueller et al.
(Continued)

FOREIGN PATENT DOCUMENTS

JP 2011510475 A 3/2011
WO 2008112735 A2 9/2008
(Continued)

OTHER PUBLICATIONS

Joep Jacobs; "Dimming SSL Lamps Focus on eW Products of Philips Color Kinetics", Dec. 2008, pp. 1-8.
(Continued)

*Primary Examiner* — Douglas W Owens
*Assistant Examiner* — Wei Chan

(57) ABSTRACT

A method is provided for detecting and correcting improper operation of a lighting system including a solid state lighting load. The method includes detecting first and second values of a phase angle of a dimmer connected to a power converter driving the solid state lighting load, the first and second values corresponding to consecutive half cycles of an input mains voltage signal, and determining a difference between the first and second values. When the difference is greater than a difference threshold, indicating asymmetric waveforms of the input mains voltage signal, a selected corrective action is implemented.

20 Claims, 7 Drawing Sheets

(51) Int. Cl.
*H05B 39/04* (2006.01)
*H05B 41/24* (2006.01)
*H05B 33/08* (2006.01)

(58) Field of Classification Search
USPC ..... 315/291, 247, 307, 246, 224, 225, 297,315/326
See application file for complete search history.

(56) References Cited

U.S. PATENT DOCUMENTS

| | | | | |
|---|---|---|---|---|
| 6,091,205 | A * | 7/2000 | Newman et al. | 315/194 |
| 6,211,626 | B1 | 4/2001 | Lys et al. | |
| 7,256,554 | B2 | 8/2007 | Lys | |
| 7,852,017 | B1 * | 12/2010 | Melanson | 315/291 |
| 8,018,171 | B1 * | 9/2011 | Melanson et al. | 315/194 |
| 8,093,826 | B1 * | 1/2012 | Eagar et al. | 315/291 |
| 8,115,419 | B2 * | 2/2012 | Given et al. | 315/307 |
| 8,212,491 | B2 * | 7/2012 | Kost et al. | 315/247 |
| 8,242,766 | B2 * | 8/2012 | Gaknoki et al. | 323/300 |
| 8,664,889 | B2 * | 3/2014 | Newman et al. | 315/291 |
| 2006/0255745 | A1 * | 11/2006 | DeJonge et al. | 315/209 R |
| 2007/0097484 | A1 * | 5/2007 | Libretto et al. | 359/275 |
| 2007/0182347 | A1 * | 8/2007 | Shteynberg et al. | 315/312 |
| 2008/0224636 | A1 * | 9/2008 | Melanson | 315/307 |
| 2009/0108765 | A1 * | 4/2009 | Weightman et al. | 315/224 |
| 2009/0160369 | A1 | 6/2009 | Godbole et al. | |
| 2009/0160627 | A1 * | 6/2009 | Godbole | 340/310.11 |
| 2010/0270982 | A1 * | 10/2010 | Hausman et al. | 320/166 |
| 2011/0121752 | A1 * | 5/2011 | Newman et al. | 315/291 |
| 2011/0121812 | A1 * | 5/2011 | Salvestrini | 323/323 |
| 2011/0194311 | A1 * | 8/2011 | Gaknoki | H02M 7/217 363/21.12 |
| 2011/0254525 | A1 * | 10/2011 | Gaknoki et al. | 323/283 |
| 2011/0291587 | A1 * | 12/2011 | Melanson et al. | 315/291 |
| 2011/0316441 | A1 * | 12/2011 | Huynh | 315/291 |

FOREIGN PATENT DOCUMENTS

| | | | |
|---|---|---|---|
| WO | 2009094329 | A1 | 7/2009 |
| WO | 2009101544 | A2 | 8/2009 |
| WO | 2011036588 | A1 | 3/2011 |
| WO | 2011121511 | A1 | 10/2011 |

OTHER PUBLICATIONS

Microchip, PIC12F683, Data Sheet, 8-Pin Flash-Based, 8-bit, CMOS Microcontrollers With Nano Watt Technology, Feb. 17, 2004.

* cited by examiner

METHOD AND APPARATUS FOR DETECTING AND CORRECTING IMPROPER DIMMER OPERATION

TECHNICAL FIELD

The present invention is directed generally to control of solid state lighting fixtures. More particularly, various inventive methods and apparatuses disclosed herein relate to detecting and correcting improper operation of a dimmer in a lighting system including a solid state lighting load.

BACKGROUND

Digital or solid state lighting technologies, i.e., illumination based on semiconductor light sources, such as light-emitting diodes (LEDs), offer a viable alternative to traditional fluorescent, high-intensity discharge (HID), and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications.

Some of the fixtures embodying these sources feature a lighting module, including one or more LEDs capable of producing white light and/or different colors of light, e.g., red, green and blue, as well as a controller or processor for independently controlling the output of the LEDs in order to generate a variety of colors and color-changing lighting effects, for example, as discussed in detail in U.S. Pat. Nos. 6,016,038 and 6,211,626. LED technology includes line voltage powered luminaires, such as the ESSENTIALWHITE series, available from Philips Color Kinetics. Such luminaires may be dimmable using trailing edge dimmer technology, such as electric low voltage (ELV) type dimmers for 120VAC or 220VAC line voltages (or input mains voltages).

Many lighting applications make use of dimmers. Conventional dimmers work well with incandescent (bulb and halogen) lamps. However, problems occur with other types of electronic lamps, including compact fluorescent lamp (CFL), low voltage halogen lamps using electronic transformers and solid state lighting (SSL) lamps, such as LEDs and OLEDs. Low voltage halogen lamps using electronic transformers, in particular, may be dimmed using special dimmers, such as ELV type dimmers or resistive-capacitive (RC) dimmers, which work adequately with loads that have a power factor correction (PFC) circuit at the input.

Conventional dimmers typically chop a portion of each waveform of the input mains voltage signal and pass the remainder of the waveform to the lighting fixture. A leading edge or forward-phase dimmer chops the leading edge of the voltage signal waveform. A trailing edge or reverse-phase dimmer chops the trailing edges of the voltage signal waveforms. Electronic loads, such as LED drivers, typically operate better with trailing edge dimmers.

Unlike incandescent and other resistive lighting devices which respond naturally without error to a chopped sine wave produced by a phase chopping dimmer, LEDs and other solid state lighting loads may incur a number of problems when placed on such phase chopping dimmers, such as low end drop out, triac misfiring, minimum load issues, high end flicker, and large steps in light output. Some problems involve compatibility among components of the lighting system, such as the phase chopping dimmers and the solid state lighting load drivers (e.g., power converters), and exhibit corresponding symptoms that result in undesirable flicker in the light output. The flicker is typically caused by a lack of uniformity among the chopped sine waves of the rectified input mains voltage signal, where the waveforms are asymmetrical.

For example, FIG. 1A shows waveforms of an unrectified input mains voltage signal input to a phase chopping dimmer, where the unrectified input mains voltage signal has periodically occurring positive and negative half cycles. FIG. 1B shows chopped waveforms of the rectified input mains voltage signal output from the dimmer, where the dimming level is about 50 percent, as indicated by the relative position of the dimmer slider. More particularly, FIG. 1B shows a scenario in which the dimmer and the solid state lighting load driver are functioning correctly, and thus provide substantially uniform rectified chopped sine waves corresponding to the positive and negative half cycles. That is, the dimmed rectified input mains voltage signal has symmetrical chopping of both the positive and negative half cycles of the unrectified input mains voltage.

In contrast, FIG. 1C shows chopped waveforms of the rectified input mains voltage signal output from the dimmer, where the dimmer and the solid state lighting load driver are functioning incorrectly, and thus provide non-uniform rectified chopped sine waves. That is, the dimmed rectified input mains voltage signal has asymmetrical chopping of the positive and negative half cycles of the unrectified input mains voltage. This asymmetrical presentation in the chopped waveforms of the rectified input mains voltage signal results in flickering in the light output at the solid state lighting load.

The improper operation may result from multiple possible problems. One problem is insufficient load current passing through the dimmer's internal switch. The dimmer derives its internal timing signals based on the current going through the solid state lighting load. Because solid state lighting load may be a small fraction of an incandescent load, the current drawn through the dimmer may not be sufficient to ensure correct operation of the internal timing signals. Another problem is that the dimmer may derive its internal power supply, which keeps its internal circuits operating, via the current drawn through the load. When the load is not sufficient, the internal power supply of the dimmer may drop out, causing the asymmetries in the waveforms.

Thus, there is a need in the art to detect improper operation of lighting system components, such as the dimmer and/or the solid state lighting load driver, and to identify and implement corrective action to correct the improper operation and/or remove power to the solid state lighting load, to eliminate undesirable effects, such as light flicker.

SUMMARY

The present disclosure is directed to inventive methods and devices for detecting incorrect operation of a solid state lighting system, indicated by asymmetries in positive and negative half cycles of the input mains voltage signal, and selectively implementing corrective actions.

Generally, in one aspect, the invention relates to a method for detecting and correcting improper operation of a lighting system including a solid state lighting load. The method includes detecting first and second measurements of a phase angle of a dimmer connected to a power converter driving the solid state lighting load, the first and second measurements corresponding to consecutive half cycles of an input mains voltage signal, and determining a difference between the first and second measurements. When the difference is greater than a difference threshold, indicating asymmetric waveforms of the input mains voltage signal, a selected corrective action is implemented.

In another aspect, in general, the invention focuses on a system for controlling power delivered to a solid state lighting load includes a dimmer, a power converter and a phase angle detection circuit. The dimmer is connected to voltage mains and configured to adjustably dim light output by the solid state lighting load. The power converter is configured to drive the solid state light load in response to a rectified input voltage signal originating from the voltage mains. The phase angle detection circuit is configured to detect a phase angle of the dimmer having consecutive half cycles of the input voltage signal, to determine a difference between the consecutive half cycles, and to implement a corrective action when the difference is greater than a difference threshold, indicating asymmetric waveforms of the input voltage signal.

In yet another aspect, the invention relates to a method for eliminating flicker from light output by an LED light source driven by a power converter in response to a phase chopping dimmer. The method includes detecting a dimmer phase angle by measuring half cycles of an input voltage signal, comparing consecutive half cycles to determine a half cycle difference, and comparing the half cycle difference with a predetermined difference threshold, where the half cycle difference being less than the difference threshold indicates that waveforms of the input voltage signal are symmetric and the half cycle difference being greater than the difference threshold indicates that the waveforms of the input voltage signal are asymmetric. A corrective action is implemented when the half cycle difference is greater than the difference threshold.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., LED white lighting fixture) may include a number of dies which respectively emit different spectra of electroluminescence that, in combination, mix to form essentially white light. In another implementation, an LED white lighting fixture may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white light LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, microcontrollers, application specific integrated circuits (ASICs), and field-programmable gate arrays (FPGAs).

In various implementations, a processor and/or controller may be associated with one or more storage media (generically referred to herein as "memory," e.g., volatile and non-volatile computer memory such as random-access memory (RAM), read-only memory (ROM), programmable read-only memory (PROM), electrically programmable read-only memory (EPROM), electrically erasable and programmable read only memory (EEPROM), universal serial bus (USB) drive, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Generally, it is desirable to have steady light output from a solid state lighting load, such as an LED light source, e.g., without flicker or uncontrolled fluctuation in output light levels, regardless of dimmer settings. Applicant has recognized and appreciated that it would be beneficial to provide a circuit capable of detecting and correcting various problems caused by a dimmer and a solid state lighting load and corresponding power converter driving the solid state lighting load. In various embodiments, the problems may be detected by identifying asymmetries in positive and negative mains half cycles, e.g., due to an interaction between an electronic transformer or power converter and a phase chopping dimmer.

In view of the foregoing, various embodiments and implementations of the present invention are directed to a circuit and method for detecting and correcting improper operation of solid state lighting fixtures caused by asymmetries in positive and negative mains half cycles, by digitally detecting and measuring the phase angle of the dimmer, and implementing corrective action when a difference between consecutive measurements (e.g., respectively corresponding to positive and negative half-cycles) exceeds a predetermined threshold, indicating asymmetrical phase chopping.

Figure 2:
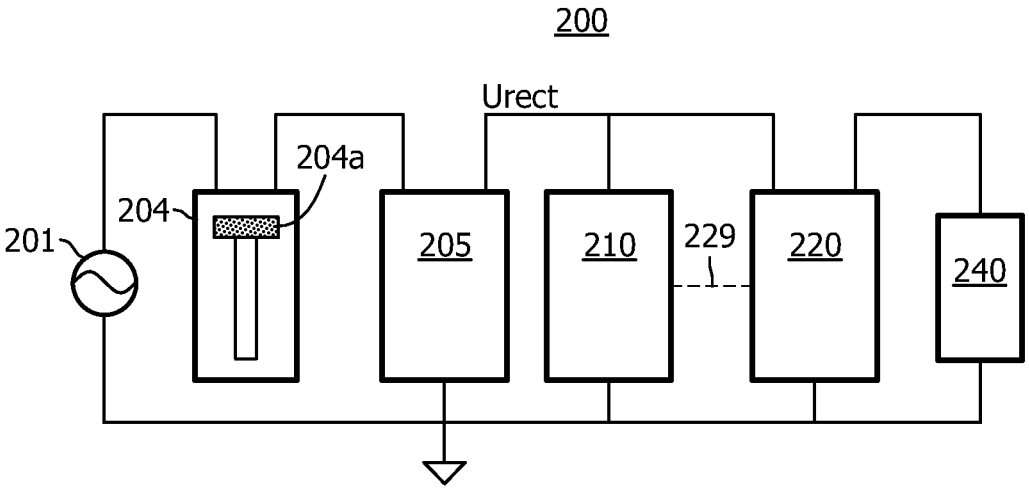
FIG. 2 is a block diagram showing a dimmable lighting system, according to a representative embodiment.

FIG. 2 is a block diagram showing a dimmable lighting system, according to a representative embodiment. Referring to FIG. 2, lighting system 200 includes dimmer 204 and rectification circuit 205, which provide a (dimmed) rectified voltage Urect from voltage mains 201. The voltage mains 201 may provide different unrectified input mains voltages, such as 100VAC, 120VAC, 230VAC and 277VAC, according to various implementations. The dimmer 204 is a phase chopping dimmer, for example, which provides dimming capability by chopping trailing edges (trailing edge dimmer) or leading edges (leading edge dimmer) of voltage signal waveforms from the voltage mains 201 in response to vertical operation of its slider 204*a*. For purposes of discussion, it is assumed that the dimmer 204 is a trailing edge dimmer.

Generally, the magnitude of the rectified voltage Urect is proportional to a phase angle or level of dimming set by the dimmer 204, such that a phase angle corresponding to a lower dimmer setting results in a lower rectified voltage Urect and vice versa. In the depicted example, it may be assumed that the slider 204*a* is moved downward to lower the phase angle, reducing the amount of light output by solid state lighting load 240, and is moved upward to increase the phase angle, increasing the amount of light output by the solid state lighting load 240. Therefore, the least dimming occurs when the slider 204*a* is at the top position (as depicted in FIG. 2), and the most dimming occurs when the slider 204*a* is at its bottom position.

Figure 1A:
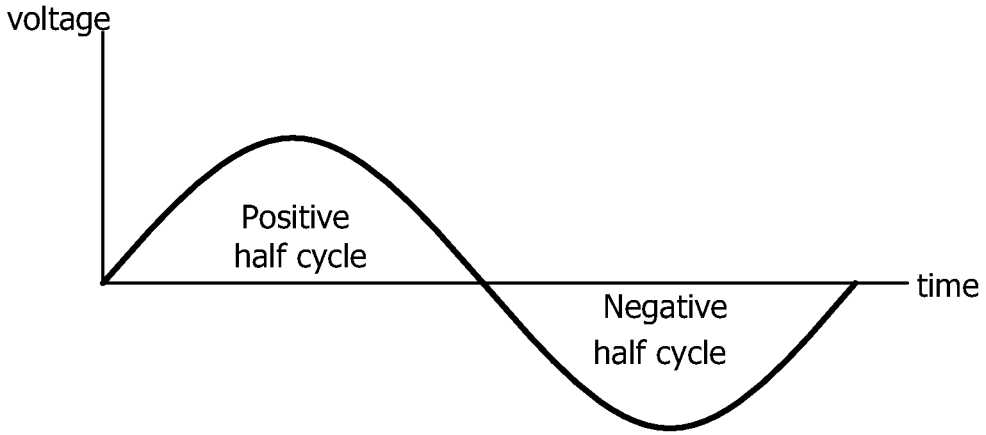
FIG. 1A PRIOR ART
FIGS. 1A-1C show unrectified waveforms and chopped rectified waveforms having symmetric and asymmetric half cycles.
Figure 1B:
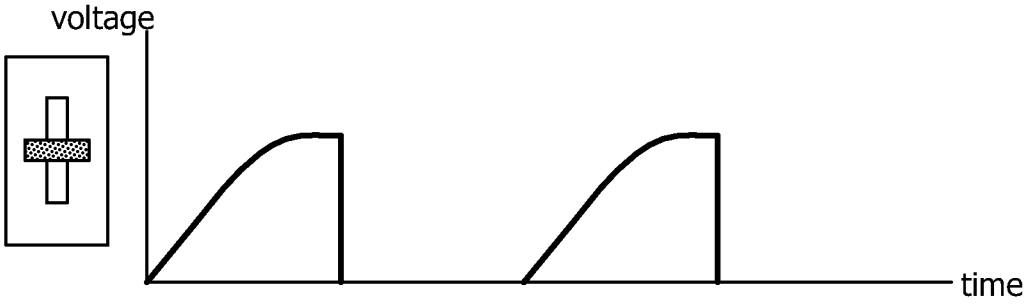
FIG. 1B PRIOR ART
Figure 1C:
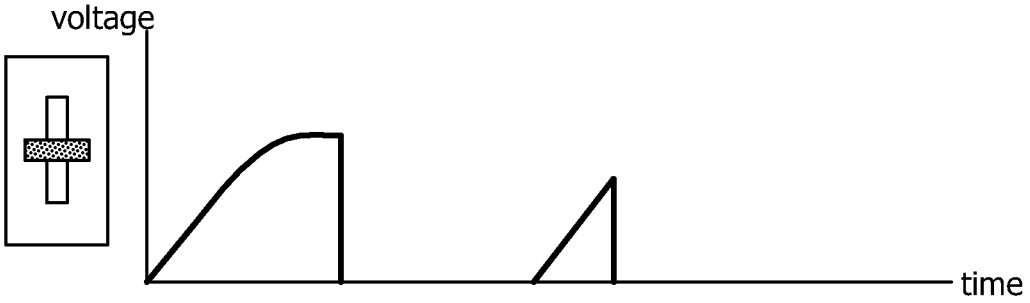
FIG. 1C PRIOR ART

The lighting system 200 further includes dimmer phase angle detection circuit 210 and power converter 220. The phase angle detection circuit 210 includes a microcontroller or other controller, discussed below, and is configured to determine or measure values of the phase angle (dimming level) of the representative dimmer 204 based on the rectified voltage Urect. The phase angle detection circuit 210 also compares detected phase angle values corresponding to positive and negative half cycles of the rectified voltage Urect, and implements corrective action if the comparison of the positive and negative half cycles indicates that the lighting system 200 is operating improperly. For example, the detected phase angle may be used as an input to a software algorithm to determine whether the chopped waveforms of the rectified voltage Urect are being chopped symmetrically (e.g., as shown in FIG. 1B) or asymmetrically (as shown in FIG. 1C). Stated differently, it is determined whether the chopped waveforms are symmetric or asymmetric. Asymmetrical chopping is indicative of a problem with the dimmer-driver system, e.g., including the dimmer 204 and the power converter 220. In various embodiments, the phase angle detection circuit 210 may be further configured to adjust dynamically an operating point of the power converter 220 during normal operations based, in part, on the detected phase angles, using a power control signal via control line 229.

Figure 3A:
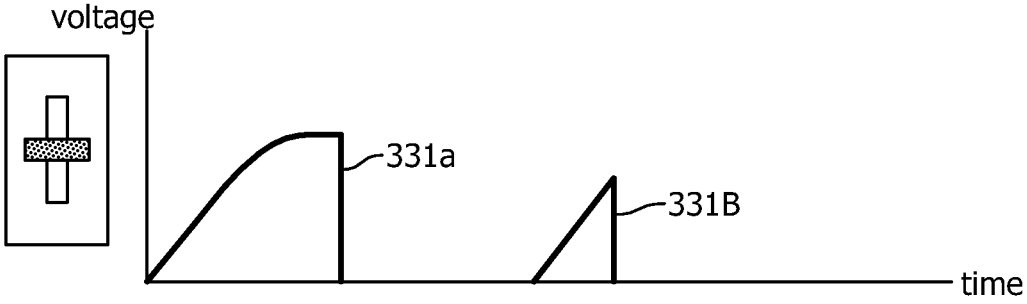
FIGS. 3A and 3B show sample waveforms and corresponding digital pulses from asymmetric half cycles of a dimmer, according to a representative embodiment.
Figure 3B:
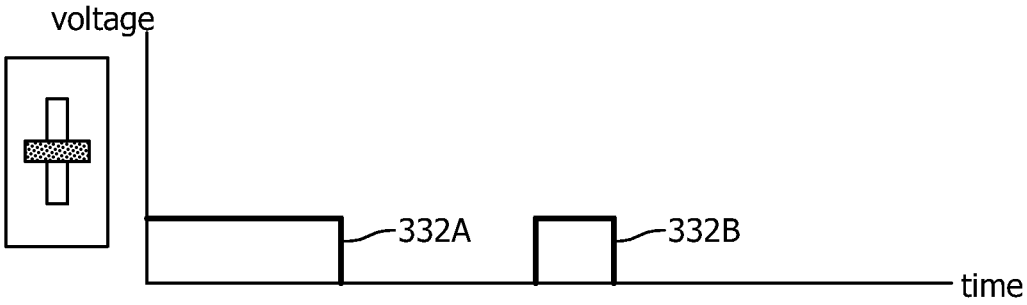

Generally, asymmetries in the chopped waveforms can be detected by detecting large differences in lengths of phase angle detection pulses, generated by the phase angle detection circuit 210, from positive half cycles to negative half cycles. For example, FIGS. 3A and 3B show chopped waveforms from the dimmer 204 and the rectification circuit 205 corresponding to positive and negative half cycles of the rectified voltage Urect, and associated digital pulses generated by the phase angle detection circuit 210, according to a representative embodiment. As shown in FIG. 3B, the length of the second digital pulse 332*b* is significantly smaller than the length of the first digital pulse 331*b*, indicating that the negative half cycle waveform 332*a* is more heavily chopped than the immediately preceding positive half cycle waveform 331*a*, as shown in FIG. 3A.

Typically, when a user manually operates the dimmer 204 by adjusting the slider 204*a*, the result has a very slow and gradual effect on the differences between positive and negative half cycles. Therefore, a more drastic change from one cycle to another cycle, as shown for example in FIGS. 3A and 3B, is distinguishable as improper operation. In an embodiment, a difference threshold may be established, e.g., based on empirical measurements, which indicates the upper limit of tolerable differences between positive and negative half cycles. For example, the difference threshold may be the point at which flicker begins to occur based on the asymmetrical waveforms. As discussed below with respect to FIG. 4, the phase angle detection circuit 210 (e.g., using the microcontroller or other controller) may compare differences between the digital pulses of positive and negative half cycles with the difference threshold, and identify occurrences of improper operation when the differences exceed the difference threshold.

Because an asymmetrical waveform is a symptom of multiple potential problems, all of which result in the undesirable flicker in the light output from the solid state lighting load 240, different corrective actions or methods can be attempted under control of the phase angle detection circuit 210 to correct the problem. For example, the phase angle detection circuit 210 may switch in a resistive bleeder circuit (not shown in FIG. 2), in parallel with the solid state lighting load 240, to draw extra current along with the solid state lighting load 240, thus increasing the load to a sufficient minimum for operation of the dimmer 204. If this action does not correct the flicker or the underlying issue, other corrective actions may be attempted. The corrective actions may be attempted in a predetermined order of priority, e.g., from most likely to least likely to be successful, until one of the corrective actions works. However, if no corrective actions work, the phase angle detection circuit 210 may simply shut down the power converter 220 using a power control signal sent via control line 229, since no light may be more desirable than flickering light. For example, the phase angle detection circuit 210 may control the power converter 220 to deliver no current to the solid state lighting load 240, or may cause the power converter 220 to shut off.

The power converter 220 receives the rectified voltage Urect from the rectification circuit 205 and the power control signal via the control line 229, and outputs a corresponding DC voltage for powering the solid state lighting load 240. Generally, the power converter 220 converts between the rectified voltage Urect and the DC voltage based on at least the magnitude of the rectified voltage Urect and the value of the power control signal received from the phase angle detection circuit 210. DC voltage output by the power converter 220 thus reflects the rectified voltage Urect and the dimmer phase angle applied by the dimmer 204. In various embodiments, the power converter 220 operates in an open loop or feed-forward fashion, as described in U.S. Pat. No. 7,256,554 to Lys, for example, which is hereby incorporated by reference.

In various embodiments, the power control signal may be a pulse width modulation (PWM) signal, for example, which alternates between high and low levels in accordance with a selected duty cycle. For example, the power control signal may have a high duty cycle (e.g., 100 percent) corresponding to a maximum on-time (high phase angle) of the dimmer 204, and a low duty cycle (e.g., 0 percent) corresponding to a minimum on-time (low phase angle) of the dimmer 204. When the dimmer 204 is set in between maximum and minimum phase angles, the phase angle detection circuit 210 determines a duty cycle of the power control signal that specifically corresponds to the detected phase angle.

Figure 4:
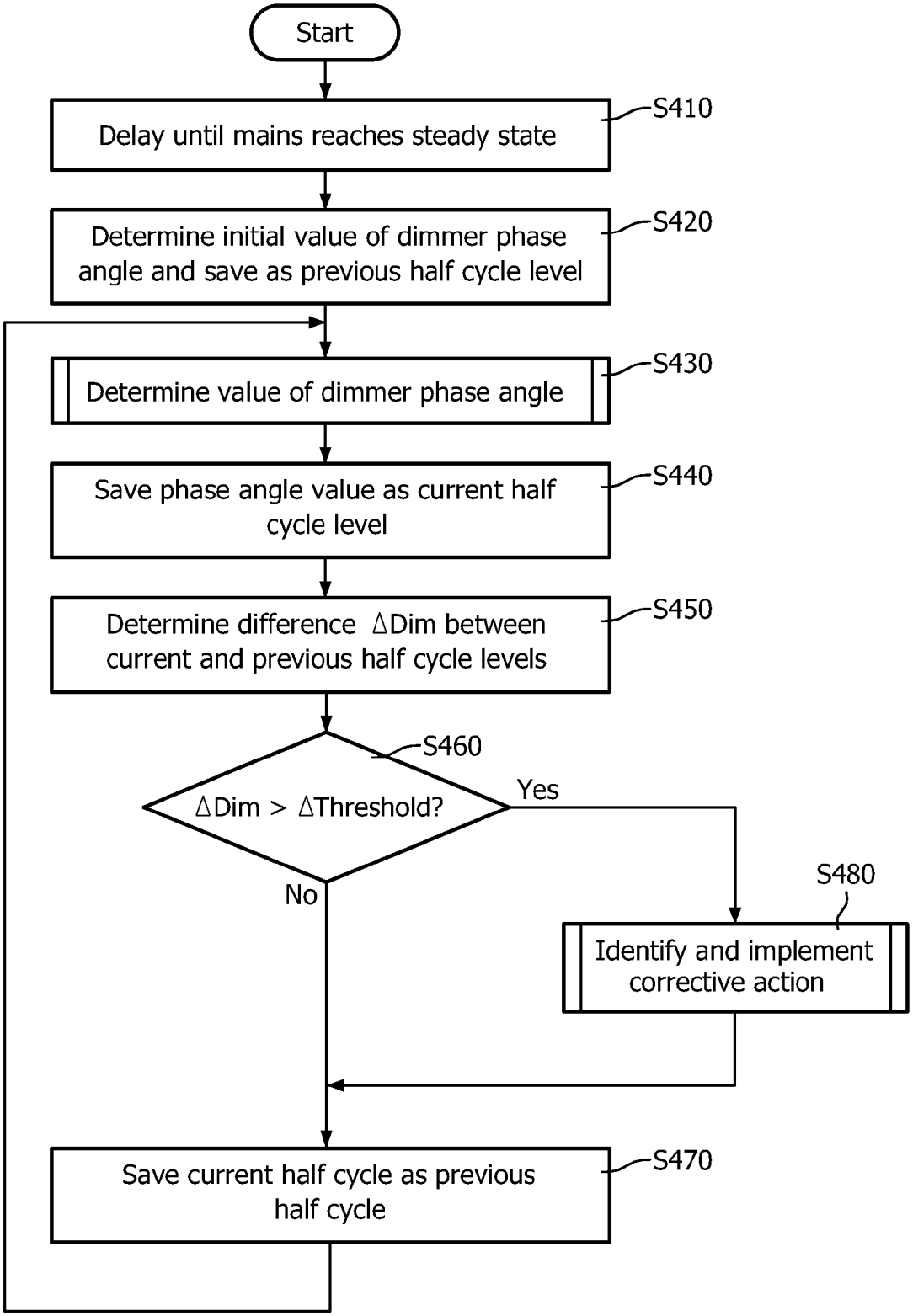
FIG. 4 is a flow diagram showing a process of detecting and correcting improper operation of a dimmable lighting system, according to a representative embodiment.

FIG. 4 is a flow diagram showing a process of detecting improper operation of a dimmable lighting system, according to a representative embodiment. The process may be implemented, for example, by firmware and/or software executed by phase angle detection circuit 210 shown in FIG. 2 (or by microcontroller 615 of FIG. 6, discussed below).

It may be assumed for purposes of explanation that FIG. 4 begins at block S410 when the lighting system 200 is powered on. In block S410, there is a delay while the rectified input mains voltage Urect reaches steady state. After the delay, an initial value of the phase angle is determined and saved as the Previous Half Cycle Level in block S420. For example, the initial value of the phase angle may be determined by simply detecting the phase angle, according to the process discussed below with reference to block S430. Alternatively, the initial value of the phase angle may be determined according to other processes or may be retrieved from memory storing a previously determined phase angle, e.g., from prior operation of the lighting system 200, without departing from the scope of the present teachings.

In the process indicated by block S430, the phase angle detection circuit 210 detects the phase angle, in order to determine or measure another value of the phase angle. In various embodiments, the phase angle is detected by obtaining a digital pulse corresponding to each chopped waveform of the rectified input mains voltage Urect, according to the algorithm discussed below with reference to FIGS. 6-8, for example. Therefore, a digital pulse is generated for each positive half cycle and negative half cycle, as shown in FIGS. 3A and 3B. Of course, the value of the phase angle may be determined according to other processes, without departing from the scope of the present teachings.

The detected phase angle is saved as the Current Half Cycle Level in block S440. The Previous Half Cycle Level and the Current Half Cycle Level may be stored in memory. For example, the memory may be an external memory or a memory internal to the phase angle detection circuit 210 and/or a microcontroller or other controller included in the phase angle detection circuit 210, as discussed below with reference to FIG. 6. In various embodiments, values of the Previous Half Cycle Level and the Current Half Cycle Level may be used to populate tables or may be saved in a relational database for comparison, although other means of storing the Previous Half Cycle Level and the Current Half Cycle Level may be incorporated without departing from the scope of the present teachings. Also, in various embodiments, the value of the phase angle detected in block S430 may be used by the phase angle detection circuit 210 to generate a power control signal, which is provided to the power controller 220 to set an operating point of the power controller 220, enabling further control over the light output by the solid state lighting load 240 based on various other control criteria.

The difference ΔDim between the Current Half Cycle Level and the Previous Half Cycle Level is determined in block S450, for example, by subtracting the Current Half Cycle Level from the Previous Half Cycle Level, or vice versa. The difference ΔDim is then compared to a predetermined difference threshold ΔThreshold in block S460 to determine whether the waveforms are asymmetric, e.g., indicating incompatibility between or improper operation of the dimmer 204 and/or the power converter 220. When the difference ΔDim is greater than the threshold ΔThreshold (block S460: Yes), indicating asymmetric waveforms, a process indicated by block S480 is performed in order to identify and implement an appropriate corrective action to address the problem causing the asymmetrical waveforms. This process is described in detail with reference to FIG. 5, below. When the difference ΔDim is not greater than the threshold ΔThreshold (block S460: No), indicating substantially symmetric waveforms, the Current Half Cycle Level is simply saved as the Previous Half Cycle Level in block S470. The process then returns to block S430 to determine again the phase angle, and the process indicated by blocks S440-S480 is repeated.

Figure 5:
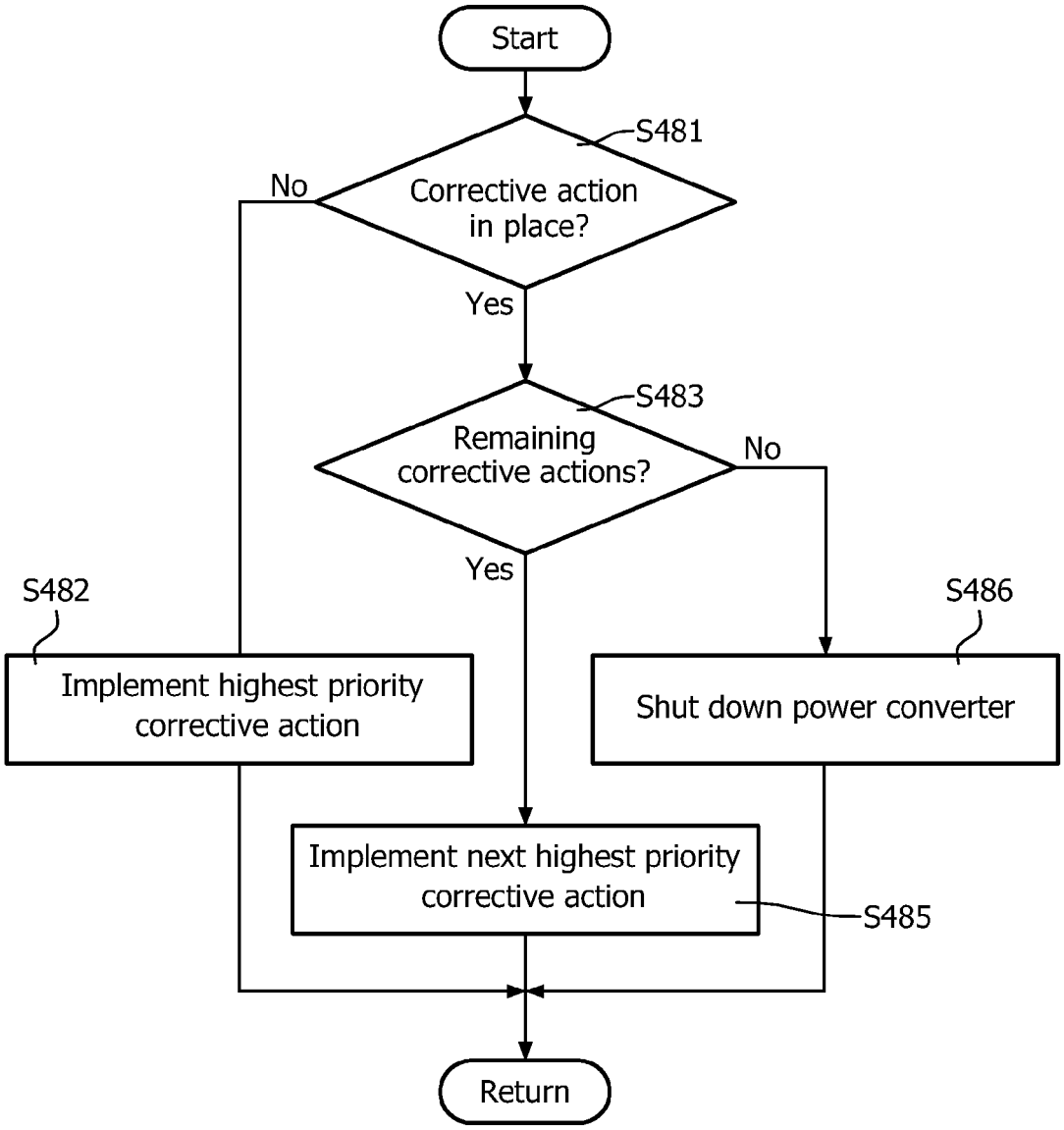
FIG. 5 is a flow diagram showing a process of identifying and implementing corrective actions, according to a representative embodiment.

FIG. 5 is a flow diagram showing a process of identifying and implementing corrective actions in response to the detection of asynchronous waveforms, according to a representative embodiment. The process may be implemented, for example, by firmware and/or software executed by phase angle detection circuit 210 shown in FIG. 2 (or by microcontroller 615 of FIG. 6 or other controller, discussed below).

In various embodiments, one or more corrective actions are available for implementation, as needed. The corrective actions may be ranked in order from highest to lowest priority, where the highest priority corrective action is the corrective action previously determined to be the most likely to address successfully the asymmetrical waveforms. The ranking, along with corresponding steps to be executed for implementation of each of the corrective actions, may be stored in memory. For example, the memory may be an external memory or a memory internal to the phase angle detection circuit 210 and/or a microcontroller or other controller included in the phase angle detection circuit 210, as discussed below with reference to FIG. 6. The highest priority corrective action may include switching in a resistive bleeder circuit in parallel with the solid state lighting load 240, for example, to increase the load of the dimmer 204 to a sufficient minimum load. The resistive bleeder circuit may include a resistance connected in series with a switch (e.g., a transistor), for example, to selectively draw additional current. One or more additional corrective actions, the implementation of which would be apparent to one of ordinary skill in the art, may be prioritized below the resistive bleeder circuit corrective action. In addition, one or more variations of the same corrective action may be prioritized. For example, implementation of the resistive bleeder circuit may be repeated using incrementally increasing resistance values, until an appropriate value is found.

Referring to FIG. 5, it is determined in block S481 whether a corrective action is already actively in place. When there is no corrective action in place (block S481: No), the highest priority corrective action is implemented in block S482, and the process returns to block S470 of FIG. 4, where the Current Half Cycle Level is saved as the Previous Half Cycle Level. The process then returns to block S430 to determine again the phase angle as the Current Half Cycle Level, the subsequent comparison of which to the Previous Half Cycle Level in blocks S450 and S460 indicates whether the corrective action implemented in block S482 is successful. As a practical matter, one or more half cycles may be evaluated after implementing a corrective action in order to allow the corrective action to take effect before making a determination as to the success of that action.

Referring again to FIG. 5, when it is determined that there is already a corrective action in place (block S481: Yes), it is then determined whether there are any remaining corrective actions that may be attempted in block S483. When there is at least one remaining corrective action (block S483: Yes), the next highest priority corrective action is implemented in block S485, and the process returns to block S470 of FIG. 4, as discussed above.

When there are not more corrective actions (block S483: No), the power converter 220 is shut down in block S486, in order to eliminate the flickering light output from the solid state lighting load 240 or other adverse affect of the improper operation. The process then returns to block S470 of FIG. 4, where the monitoring process may be repeated, even though the power converter 220 is shut down. Although not shown in FIGS. 4 and 5, in various embodiments, the power converter 220 may be turned on again if subsequent comparisons between the Current and Previous Half Cycle Levels indicate that the difference ΔDim drops below the threshold ΔThreshold, which may occur in response to further adjustments to the dimming level, e.g., through manipulation of the slider 204*a*.

In various embodiments, each time the lighting system 200 is powered on, the power converter 220 is on and no corrective actions are in place. In other words, any corrective action that may have been activated in a previous operation of the lighting system 200 is discontinued when the lighting system 200 is powered off. Likewise, any determination that the flicker could not be corrected using the available corrective actions, resulting in the power converter 220 being shut down, is not carried forward to subsequent operations of the lighting system 200. Of course, in alternative embodiments, corrective actions and/or determinations to shut down the power converter 220 may be carried forward or otherwise considered with respect to subsequent operations, without departing from the scope of the present teachings. For example, if a particular corrective action is found to adequately address the flickering of light output by the solid state lighting load 240, the priority ranking of the available corrective actions may be reordered so that the successful corrective action has the highest priority.

Further, FIG. 4 depicts an embodiment in which the process takes place continuously throughout operation of the lighting system 200. However, in alternative embodiments, the process of FIG. 4 may occur only during an initial start-up period, during which the difference ΔDim between the Current Half Cycle Level and the Previous Half Cycle Level is determined and compared with the difference threshold ΔThreshold, based on detected values of the phase angle. If no corrective actions are identified and implemented in response to the comparison (i.e., the waveforms of the input mains voltage signal are symmetrical), the process ends and the lighting system 200 operates in response to the dimmer 204 without further analysis of the difference ΔDim between the Current and Previous Half Cycle Levels. Likewise, if a corrective action is identified and successfully implemented (i.e., in response to the waveforms of the input mains voltage signal being asymmetrical), the process ends and the lighting system 200 operates in response to the dimmer 204 using the corrective action without further analysis of the difference ΔDim between the Current and Previous Half Cycle Levels. In this manner, a corrective action, such as switching in a resistive bleeder circuit, is implemented to correct the problem for the remainder of the operation without expending the additional processing power to conduct further checks.

Figure 6:
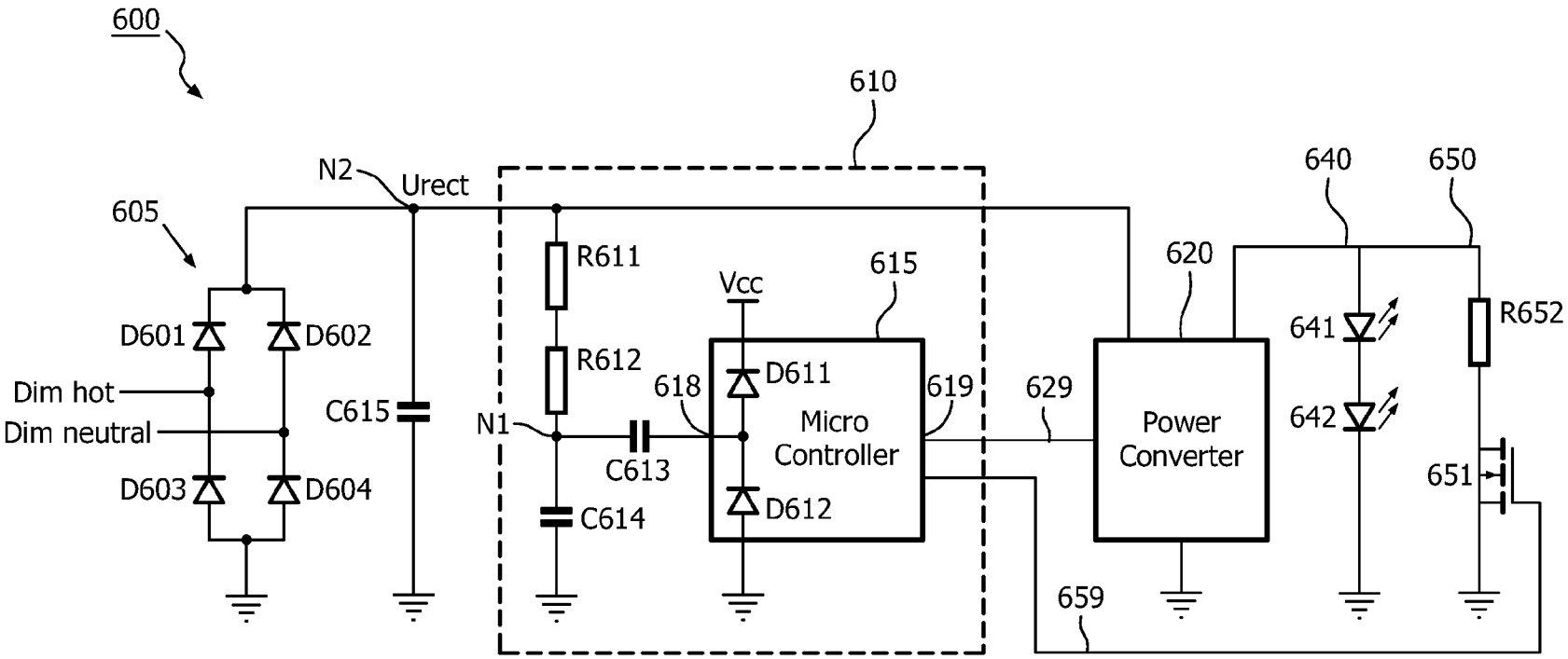
FIG. 6 is a circuit diagram showing a control circuit for a lighting system, according to a representative embodiment.

FIG. 6 is a circuit diagram showing a control circuit for a dimmable lighting system, including a phase angle detection circuit, a power converter and a solid state lighting fixture, according to a representative embodiment. The general components of FIG. 6 are similar to those of FIG. 2, although more detail is provided with respect to various representative components, in accordance with an illustrative configuration. Of course, other configurations may be implemented without departing from the scope of the present teachings.

Referring to FIG. 6, control circuit 600 includes rectification circuit 605 and phase angle detection circuit 610 (dashed box). As discussed above with respect to the rectification circuit 205, the rectification circuit 605 is connected to a dimmer connected between the rectification circuit 605 and the voltage mains to receive (dimmed) unrectified voltage, indicated by the dimmed hot and neutral inputs. In the depicted configuration, the rectification circuit 605 includes four diodes D601-D604 connected between rectified voltage node N2 and ground. The rectified voltage node N2 receives the rectified voltage Urect, and is connected to ground through input filtering capacitor C615 connected in parallel with the rectification circuit 605.

The phase angle detection circuit 610 performs a phase angle detection process based on the rectified voltage Urect. The phase angle corresponding to the level of dimming set by the dimmer is detected based on the extent of phase chopping present in a signal waveform of the rectified voltage Urect. The power converter 620 controls operation of the LED load 640, which includes representative LEDs 641 and 642 connected in series, based on the rectified voltage Urect (RMS input voltage) and, in various embodiments, a power control signal provided by the phase angle detection circuit 610 via control line 629. This allows the phase angle detection circuit 610 to adjust the power delivered from the power converter 620 to the LED load 640. The power control signal may be a PWM signal or other digital signal, for example. In various embodiments, the power converter 620 operates in an open loop or feed-forward fashion, as described in U.S. Pat. No. 7,256,554 to Lys, for example, which is hereby incorporated by reference.

In the depicted representative embodiment, the phase angle detection circuit 610 includes microcontroller 615, which uses signal waveforms of the rectified voltage Urect to determine the phase angle. The microcontroller 615 includes digital input 618 connected between a first diode D611 and a second diode D612. The first diode D611 has an anode connected to the digital input 618 and a cathode connected to voltage source Vcc, and the second diode D612 has an anode connected to ground and a cathode connected to the digital input 618. The microcontroller 615 also includes the digital output 619.

In various embodiments, the microcontroller 615 may be a PIC12F683, available from Microchip Technology, Inc., and the power converter 620 may be an L6562, available from ST Microelectronics, for example, although other types of microcontrollers, power converters, or other processors and/or controllers may be included without departing from the scope of the present teachings. For example, the functionality of the microcontroller 615 may be implemented by one or more processors and/or controllers, connected to receive digital input between first and second diodes D611 and D612 as discussed above, and which may be programmed using software or firmware (e.g., stored in a memory) to perform the various functions described herein, or may be implemented as a combination of dedicated hardware to perform some functions and a processor (e.g., one or more programmed microprocessors and associated circuitry) to perform other functions. Examples of controller components that may be employed in various embodiments include, but are not limited to, conventional microprocessors, microcontrollers, ASICs and FPGAs, as discussed above.

The phase angle detection circuit 610 further includes various passive electronic components, such as first and second capacitors C613 and C614, and a resistance indicated by representative first and second resistors R611 and R612. The first capacitor C613 is connected between the digital input 618 of the microcontroller 615 and a detection node N1. The second capacitor C614 is connected between the detection node N1 and ground. The first and second resistors R611 and R612 are connected in series between the rectified voltage node N2 and the detection node N1. In the depicted embodiment, the first capacitor C613 may have a value of about 560 pF and the second capacitor C614 may have a value of about 10 pF, for example. Also, the first resistor R611 may have a value of about 1 megohm and the second resistor R612 may have a value of about 1 megohm, for example. However, the respective values of the first and second capacitors C613 and C614, and the first and second resistors R611 and R612 may vary to provide unique benefits for any particular situation or to meet application specific design requirements of various implementations, as would be apparent to one of ordinary skill in the art.

The rectified voltage Urect is AC coupled to the digital input 618 of the microcontroller 615. The first resistor R611 and the second resistor R612 limit the current into the digital input 618. When a signal waveform of the rectified voltage Urect goes high, the first capacitor C613 is charged on the rising edge through the first and second resistors R611 and R612. The first diode D611 clamps the digital input 618 one diode drop above the voltage source Vcc, for example, while the first capacitor C613 is charged. The first capacitor C613 remains charged as long as the signal waveform is not zero. On the falling edge of the signal waveform of the rectified voltage Urect, the first capacitor C613 discharges through the second capacitor C614, and the digital input 618 is clamped to one diode drop below ground by the second diode D612. When a trailing edge dimmer is used, the falling edge of the signal waveform corresponds to the beginning of the chopped portion of the waveform. The first capacitor C613 remains discharged as long as the signal waveform is zero. Accordingly, the resulting logic level digital pulse at the digital input 618 closely follows the movement of the chopped rectified voltage Urect, examples of which are shown in FIGS. 7A-7C.

Figure 7A:
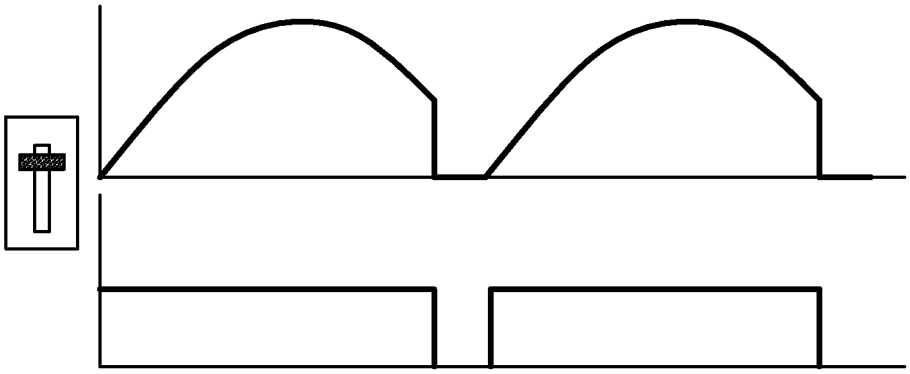
FIGS. 7A-7C show sample waveforms and corresponding digital pulses of a dimmer, according to a representative embodiment.
Figure 7B:
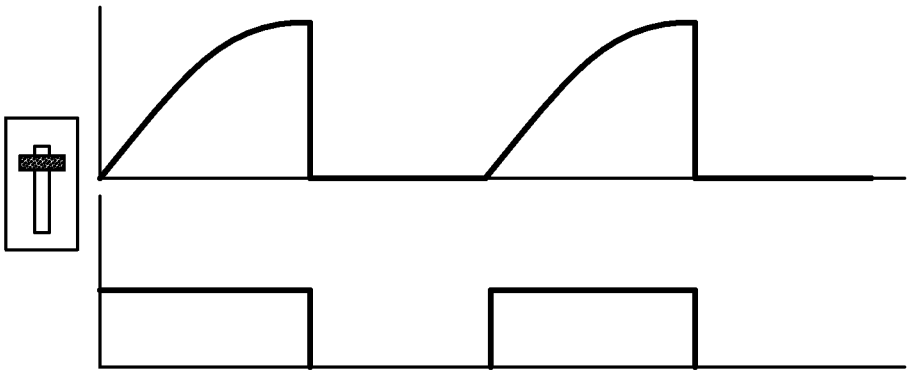
Figure 7C:
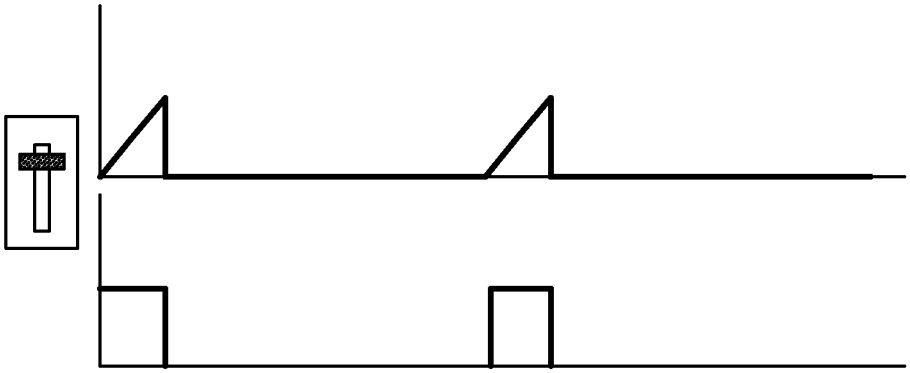

More particularly, FIGS. 7A-7C show sample waveforms and corresponding digital pulses at the digital input 618, according to representative embodiments. The top waveforms in each figure depict the chopped rectified voltage Urect, where the amount of chopping reflects the level of dimming. For example, the waveforms may depict a portion of a full 170V (or 340V for E.U.) peak, rectified sine wave that appears at the output of the dimmer. The bottom square waveforms depict the corresponding digital pulses seen at the digital input 618 of the microcontroller 615. Notably, the length of each digital pulse corresponds to a chopped waveform, and thus is equal to the dimmer on-time (e.g., the amount of time the dimmer's internal switch is "on"). By receiving the digital pulses via the digital input 618, the microcontroller 615 is able to determine the level to which the dimmer has been set.

FIG. 7A shows sample waveforms of rectified voltage Urect and corresponding digital pulses when the dimmer is at about its maximum setting, indicated by the top position of the dimmer slider shown next to the waveforms. FIG. 7B shows sample waveforms of rectified voltage Urect and corresponding digital pulses when the dimmer is at a medium setting, indicated by the middle position of the dimmer slider shown next to the waveforms. FIG. 7C shows sample waveforms of rectified voltage Urect and corresponding digital pulses when the dimmer is at about its minimum setting, indicated by the bottom position of the dimmer slider shown next to the waveforms.

Figure 8:
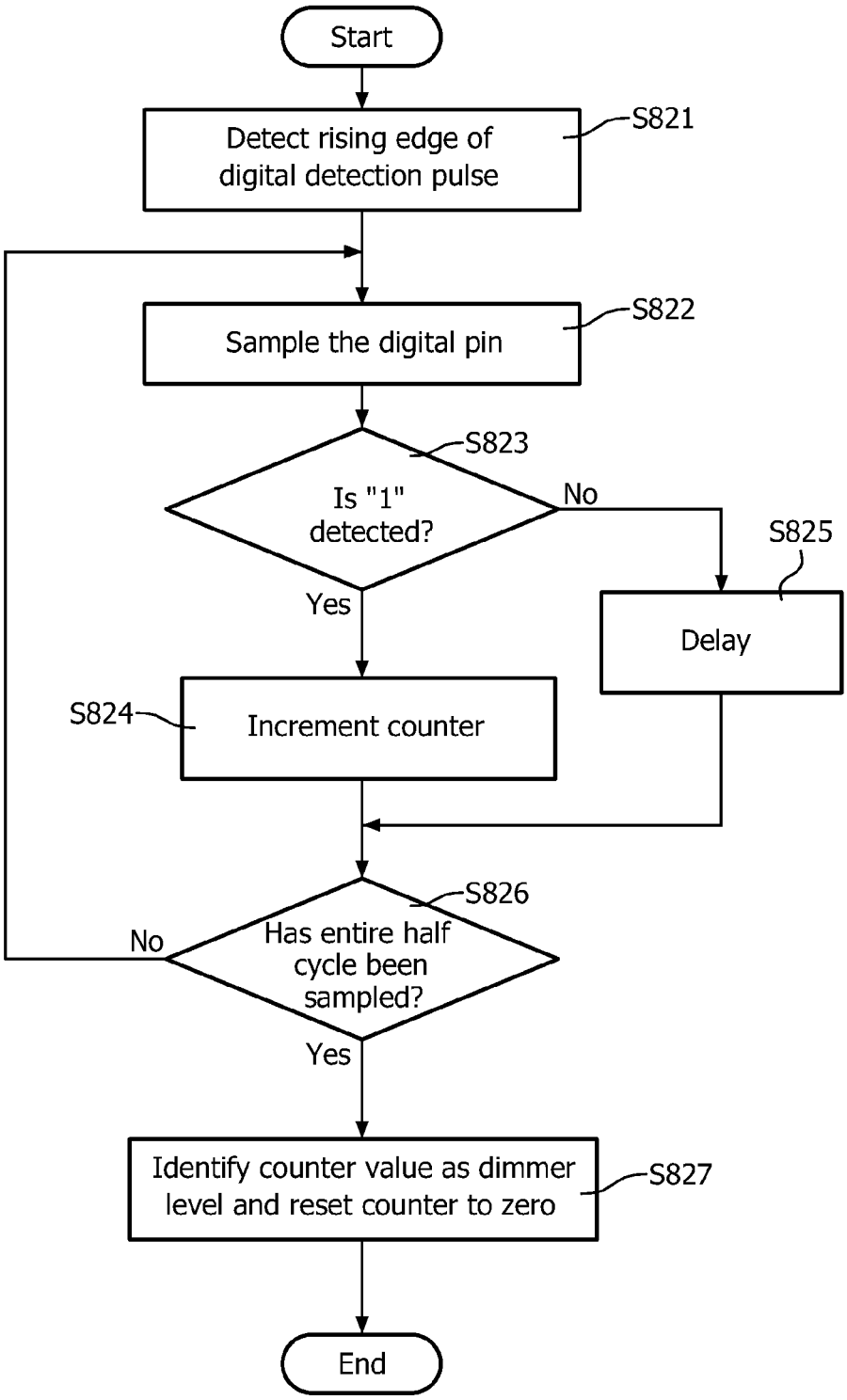
FIG. 8 is a flow diagram showing a process of detecting phase angles, according to a representative embodiment.

FIG. 8 is a flow diagram showing a process of detecting the phase angle of a dimmer, according to a representative embodiment. The process may be implemented by firmware and/or software executed by the microcontroller 615 shown in FIG. 6, or more generally by a processor or controller, e.g., the phase angle detection circuit 210 shown in FIG. 2, for example.

In block S821 of FIG. 8, a rising edge of a digital pulse of an input signal (e.g., indicated by rising edges of the bottom waveforms in FIGS. 7A-7C) is detected, for example, by initial charging of the first capacitor C613. Sampling at the digital input 618 of the microcontroller 615, for example, begins in block S822. In the depicted embodiment, the signal is sampled digitally for a predetermined time equal to just under a mains half cycle. Each time the signal is sampled, it is determined in block S823 whether the sample has a high level (e.g., digital "1") or a low level (e.g., digital "0"). In the depicted embodiment, a comparison is made in block S823 to determine whether the sample is digital "1." When the sample is digital "1" (block S823: Yes), a counter is incremented in block S824, and when the sample is not digital "1" (block S823: No), a small delay is inserted in block S825. The delay is inserted so that the number of clock cycles (e.g., of the microcontroller 615) is equal regardless of whether the sample is determined to be digital "1" or digital "0."

In block S826, it is determined whether the entire mains half cycle has been sampled. When the mains half cycle is not complete (block S826: No), the process returns to block S822 to again sample the signal at the digital input 618. When the mains half cycle is complete (block S826: Yes), the sampling stops and the counter value accumulated in block S824 is identified as the current value of the phase angle in block S827, and the counter is reset to zero. The counter value may be stored in a memory, examples of which are discussed above. The microcontroller 615 may then wait for the next rising edge to begin sampling again. For example, it may be assumed that the microcontroller 615 takes 255 samples during a mains half cycle. When the dimmer phase angle is set by the slider at the top of its range (e.g., as shown in FIG. 7A), the counter will increment to about 255 in block S824 of FIG. 8. When the dimmer phase angle is set by the slider at the bottom of its range (e.g., as shown in FIG. 7C), the counter will increment to only about 10 or 20 in block S824. When the dimmer phase angle is set somewhere in the middle of its range (e.g., as shown in FIG. 7B), the counter will increment to about 128 in block S824. The value of the counter thus gives the microcontroller 615 an accurate indication of the level to which the dimmer has been set or the phase angle of the dimmer. In various embodiments, the value of the phase angle may be calculated, e.g., by the microcontroller 615, using a predetermined function of the counter value, where the function may vary in order to provide unique benefits for any particular situation or to meet application specific design requirements of various implementations, as would be apparent to one of ordinary skill in the art.

Referring again to FIG. 6, the microcontroller 615 may also be configured to detect improper operation of the dimmer (not shown) and/or the power converter 620, causing the LED load 640 to output flickering light, and to identify and implement corrective action, as discussed above with reference to FIGS. 4 and 5. In the depicted example, the control circuit 600 includes representative resistive bleeder circuit 650, which is assumed to be the highest priority corrective action for purposes of explanation. The resistive bleeder circuit 650 includes resistor 652 connected in series with a switch, depicted as transistor 651. The transistor 651 is shown as a field effect transistor (FET), for example, such as a metal-oxide-semiconductor field-effect transistor (MOSFET) or gallium arsenide field-effect transistor (GaAs FET), although other types of FETs and/or other types of transistors within the purview of one of ordinary skill in the art may be incorporated, without departing from the scope of the present teachings.

A gate of the transistor 651 is connected to the microcontroller 615 via control line 659. Thus, the microcontroller 615 is selectively able to turn on the transistor 651 in order to switch in the resistive bleeder circuit 650 (e.g., in accordance with block S482 of FIG. 5) and to turn off the transistor 651 to switch out the resistive bleeder circuit 650, for example, to implement the next highest priority corrective action (e.g., in accordance with block S485 of FIG. 5). When the transistor 651 is turned on, the resistance of the resistor R652 is connected in parallel with the LED load 640 to draw additional current and to increase the load of the dimmer. Also, as discussed above, when the corrective action(s), including implementation of the resistive bleeder circuit 650, are not successful, the microcontroller 615 may be configured to shut down the power converter 620, for example, via control line 629. In addition, the microcontroller 615 may be configured to execute one or more additional control algorithms to adjust dynamically an operating point of the power converter 620 based, at least in part, on the detected phase angles, using a power control signal via the control line 629.

Generally, it is contemplated to ensure that flickering does not occur in the light output by a solid state lighting fixture due to incompatibility between the drivers (e.g., power converters) and phase chopping dimmers. According to various embodiments, a process detects improper operation, attempts to correct it, and shuts off the light output by the solid state lighting fixture (e.g., by shutting down the power converter) if the improper operation is not resolved by the attempted corrections. Accordingly, flicker can be eliminated, and the power converter is able to work with various different dimmers without being limited by potential incompatibility.

In various embodiments, the functionality of the phase angle detection circuit 210 and/or the microcontroller 615, for example, may be implemented by one or more processing circuits, constructed of any combination of hardware, firmware or software architectures, and may include its own memory (e.g., nonvolatile memory) for storing executable software/firmware executable code that allows it to perform the various functions. For example, the functionality may be implemented using ASICs, FPGAs, and the like.

Detecting and correcting improper dimmer operation, e.g., indicated by asymmetrical positive and negative half cycles of input mains voltage signals, can be used with any dimmable power converter with a solid state lighting (e.g., LED) load where it is desired to eliminate light flicker, or otherwise to increase compatibility with a variety of phase chopping dimmers. The phase angle detection circuit, according to various embodiments, may be implemented in various LED-based light sources. Further, it may be used as a building block of "smart" improvements to various products to make them more dimmer-friendly.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used.

Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, any reference numerals or other characters, appearing between parentheses in the claims, are provided merely for convenience and are not intended to limit the claims in any way, In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A method of detecting and correcting improper operation of a lighting system including a solid state lighting load, the method comprising:

determining first and second values of a phase angle of a dimmer using a phase angle detection circuit, the dimmer being connected to a power converter driving the solid state lighting load, the first and second values corresponding to consecutive half cycles of an input mains voltage signal;

determining a difference between the first and second values; and implementing a selected corrective action when the difference is greater than a difference threshold, indicating asymmetric waveforms of the input mains voltage signal.

2. The method of claim 1, wherein the step of implementing the selected first corrective action comprises:

determining whether a corrective action is already active; and implementing a highest priority corrective action as the selected corrective action when it is determined that no corrective action is already active.

3. The method of claim 2, wherein the step of implementing the selected corrective action further comprises:

determining whether at least one other corrective action is available when it is determined that a corrective action is already active.

4. The method of claim 3, wherein the step of implementing the selected corrective action further comprises:

implementing a next highest priority corrective action as the selected corrective action when it is determined that at least one other corrective action is available.

5. The method of claim 3, further comprising:

shutting down the power converter when it is determined that at least one other corrective action is not available.

6. The method of claim 5, further comprising:

determining third and fourth values of the phase angle of the dimmer, the third and fourth values corresponding to consecutive half cycles of the input mains voltage signal;

determining a difference between the third and fourth values; and activating the power converter when it is determined that the difference between the third and fourth values is less than the difference threshold, indicating symmetric waveforms of the input mains voltage signal.

7. The method of claim 1, wherein the step of determining the first and second values of the phase angle comprises:

sampling digital pulses corresponding to the waveforms of the input mains voltage signal; and determining lengths of the sampled digital pulses, the lengths corresponding to a level of dimming of the dimmer.

8. The method of claim 1, wherein the corrective action comprises switching in a resistive bleeder circuit in parallel with the solid state lighting load.

9. The method of claim 1, wherein determining the difference between the first and second values comprises:

storing the first value as a previous half cycle level;

storing the second value as a current half cycle level; and subtracting the stored current half cycle level and the previous half cycle level.

10. The method of claim 1, wherein implementing the selected corrective action when the difference is greater than a difference threshold eliminates flicker of light output by the solid state lighting load.

11. A system for controlling power delivered to a solid state lighting load, the system comprising:

a dimmer connected to voltage mains and configured to adjustably dim light output by the solid state lighting load;

a power converter configured to drive the solid state light load in response to a rectified input voltage signal originating from the voltage mains; and a phase angle detection circuit configured to detect a phase angle of the dimmer having consecutive half cycles of the input voltage signal, to determine a difference between respective values of the consecutive half cycles, and to implement a corrective action when the difference is greater than a difference threshold, indicating asymmetric waveforms of the input voltage signal.

12. The system of claim 11, wherein the power converter operates in an open loop or feed-forward fashion.

13. The system of claim 11, wherein the phase angle detection circuit detects the phase angle by sampling digital pulses corresponding to waveforms of the input voltage signal and measuring the consecutive half cycles based on lengths of the sampled digital pulses.

14. The system of claim 13, wherein the phase angle detection circuit determines the difference between the respective values of the consecutive half cycles by subtracting the lengths of the sampled digital pulses corresponding to the consecutive half cycles, respectively.

15. The system of claim 11, wherein the phase angle detection circuit comprises:

a processor having a digital input;

a first diode connected between the digital input and a voltage source;

a second diode connected between the digital input and ground;

a first capacitor connected between the digital input and a detection node;

a second capacitor connected between the detection node and ground; and a resistance connected between the detection node and a rectified voltage node, which receives the rectified input voltage, wherein the processor is configured to sample the digital pulses corresponding to waveforms of the input voltage signal at the digital input and to measure the respective values of the consecutive half cycles based on the lengths of the sampled digital pulses.

16. The system of claim 11, wherein the phase angle detection circuit is further configured to select the corrective action having a highest priority.

17. The system of claim 16, wherein the phase angle detection circuit is further configured to shut down the power converter when the selected corrective action is implemented, but the difference between the respective values of the consecutive half cycles continues to be greater than the difference threshold.

18. A method implemented by a phase angle detection circuit for eliminating flicker from light output by a light emitting diode (LED) light source driven by a power converter in response to a phase chopping dimmer, the method comprising:

detecting a dimmer phase angle by measuring half cycles of an input voltage signal;

comparing consecutive half cycles to determine a half cycle difference;

comparing the half cycle difference with a predetermined difference threshold, wherein the half cycle difference being less than the difference threshold indicates that waveforms of the input voltage signal are symmetric, and wherein the half cycle difference being greater than the difference threshold indicates that the waveforms of the input voltage signal are asymmetric; and implementing a corrective action when the half cycle difference is greater than the difference threshold.

19. The method of claim 18, further comprising:

comparing the half cycle difference with the predetermined difference threshold after implementing the corrective action; and implementing another corrective action when the half cycle difference is greater than the difference threshold and another corrective action is available for implementation.

20. The method of claim 19, further comprising:

shutting down the power converter when the half cycle difference is greater than the difference threshold and another corrective action is not available for implementation.

* * * * *